US010163446B2

(12) United States Patent
Koppens et al.

(10) Patent No.: US 10,163,446 B2
(45) Date of Patent: Dec. 25, 2018

(54) AUDIO ENCODER AND DECODER

(71) Applicant: DOLBY INTERNATIONAL AB, Amsterdam Zuidoost (NL)

(72) Inventors: Jeroen Koppens, Södertälje (SE); Lars Villemoes, Järfälla (SE); Toni Hirvonen, Stockholm (SE); Kristofer Kjoerling, Solna (SE)

(73) Assignee: Dolby International AB, Amsterdam Zuidoost (NL)

( * ) Notice: Subject to any disclaimer, the term of this patent is extended or adjusted under 35 U.S.C. 154(b) by 0 days.

(21) Appl. No.: 15/515,775

(22) PCT Filed: Oct. 1, 2015

(86) PCT No.: PCT/EP2015/072666

§ 371 (c)(1),
(2) Date: Mar. 30, 2017

(87) PCT Pub. No.: WO2016/050899

PCT Pub. Date: Apr. 7, 2016

(65) Prior Publication Data

US 2017/0249945 A1 Aug. 31, 2017

Related U.S. Application Data

(60) Provisional application No. 62/058,157, filed on Oct. 1, 2014.

(51) Int. Cl.
*G10L 19/008* (2013.01)
*G10L 21/0208* (2013.01)
(Continued)

(52) U.S. Cl.
CPC ..... *G10L 19/008* (2013.01); *G10L 21/0316* (2013.01); *G10L 21/0364* (2013.01); *G10L 21/0208* (2013.01)

(58) Field of Classification Search
CPC ..... G10L 19/008
See application file for complete search history.

(56) References Cited

U.S. PATENT DOCUMENTS 5,870,480 A 2/1999 Griesinger
6,311,155 B1 10/2001 Vaudrey
(Continued)

FOREIGN PATENT DOCUMENTS

EP 2 118 892 11/2009
WO 2011/031273 3/2011
(Continued)

OTHER PUBLICATIONS

Fuchs, Harald, and Dirk Oetting. "Advanced clean audio solution: Dialogue enhancement." (2013): 1-2. (Year: 2013).*
(Continued)

*Primary Examiner* — Brian L Albertalli

(57) ABSTRACT

This disclosure falls into the field of audio coding, in particular it is related to the field of spatial audio coding, where the audio information is represented by multiple audio objects including at least one dialog object. In particular the disclosure provides a method and apparatus for enhancing dialog in a decoder in an audio system. Furthermore, this disclosure provides a method and apparatus for encoding such audio objects for allowing dialog to be enhanced by the decoder in the audio system.

20 Claims, 5 Drawing Sheets

(51) Int. Cl.
*G10L 21/0316* (2013.01)
*G10L 21/0364* (2013.01)

(56) References Cited

U.S. PATENT DOCUMENTS 7,283,965 B1 10/2007 Michener
7,415,120 B1 * 8/2008 Vaudrey ..... H03G 3/32 381/109
8,271,276 B1 9/2012 Muesch
8,315,396 B2 11/2012 Schreiner
8,494,840 B2 7/2013 Muesch
8,692,861 B2 4/2014 Liu
8,755,543 B2 6/2014 Chabanne
2008/0049943 A1 * 2/2008 Faller ..... G10L 19/008 381/17
2009/0067634 A1 * 3/2009 Oh ..... H04S 3/008 381/17
2009/0226152 A1 9/2009 Hanes
2009/0245539 A1 * 10/2009 Vaudrey ..... H03G 7/002 381/109
2010/0014692 A1 * 1/2010 Schreiner ..... H04S 3/008 381/119
2012/0170756 A1 7/2012 Kraemer
2013/0322633 A1 * 12/2013 Stone ..... H04S 3/00 381/2
2014/0025386 A1 1/2014 Xiang
2014/0133683 A1 5/2014 Robinson
2014/0294200 A1 * 10/2014 Baumgarte ..... H03G 3/20 381/107
2015/0348564 A1 * 12/2015 Paulus ..... G10L 19/008 704/500
2016/0225387 A1 8/2016 Koppens
2017/0194009 A1 * 7/2017 Hatanaka ..... G10L 19/008

FOREIGN PATENT DOCUMENTS

WO 2014/035902 3/2014
WO 2014/036085 3/2014
WO 2014/036121 3/2014
WO 2014/099285 6/2014

OTHER PUBLICATIONS

Falch, Cornelia, Leonid Terentiev, and Jürgen Herre. "Spatial audio object coding with enhanced audio object separation." 13th International Conference on Digital Audio Effects (DAFx-10), Graz, Austria. 2010. (Year: 2010).*
Andre, C. et al "Sound for 3D Cinema and the Sense of Presence" Proc. of the 18th International Conference on Auditory Display, Atlanta, GA, US, Jun. 18-21, 2012, pp. 14-21.
Hellmuth, O. "Proposal for Extension of SAOC Technology for Advanced Clean Audio Functionality" ISO/IEC JTC1/SC29/WG11, Apr. 2013, pp. 1-12.
ISO/IEC FDIS 23003-2:2010 Information Technology—MPEG Audio Technologies—Part 2: Spatial Audio Object Coding (SAOC) Mar. 10, 2010, pp. 1-134.
Engdegard, J. et al "Spatial Audio Object Coding (SAOC)—The Upcoming MPEG Standard on Parametric Object Based Audio Coding" AES presented at the 124th Convention, May 17-20, 2008, Amsterdam, The Netherlands, pp. 1-15.

* cited by examiner

AUDIO ENCODER AND DECODER

CROSS REFERENCE TO RELATED APPLICATIONS

This application claims priority to U.S. Provisional Patent Application No. 62/058,157, filed on Oct. 1, 2014, which is hereby incorporated by reference in its entirety.

TECHNICAL FIELD

The disclosure herein generally relates to audio coding. In particular it relates to a method and apparatus for enhancing dialog in a decoder in an audio system. The disclosure further relates to a method and apparatus for encoding a plurality of audio objects including at least one object representing a dialog.

BACKGROUND ART

In conventional audio systems, a channel-based approach is employed. Each channel may for example represent the content of one speaker or one speaker array. Possible coding schemes for such systems include discrete multi-channel coding or parametric coding such as MPEG Surround.

More recently, a new approach has been developed. This approach is object-based, which may be advantageous when coding complex audio scenes, for example in cinema applications. In systems employing the object-based approach, a three-dimensional audio scene is represented by audio objects with their associated metadata (for instance, positional metadata). These audio objects move around in the three-dimensional audio scene during playback of the audio signal. The system may further include so called bed channels, which may be described as signals which are directly mapped to certain output channels of for example a conventional audio system as described above.

Dialog enhancement is a technique for enhancing or increasing the dialog level relative to other components, such as music, background sounds and sound effects. Object-based audio content may be well suited for dialog enhancement as the dialog can be represented by separate objects. However, in some situations, the audio scene may comprise a vast number of objects. In order to reduce the complexity and the amount of data required to represent the audio scene, the audio scene may be simplified by reducing the number of audio objects, i.e. by object clustering. This approach may introduce mixing between dialog and other objects in some of the object clusters.

By including dialog enhancement possibilities for such audio clusters in a decoder in an audio system, the computational complexity of the decoder may increase.

BRIEF DESCRIPTION OF THE DRAWINGS

Example embodiments will now be described with reference to the accompanying drawings, on which.

All the figures are schematic and generally only show parts which are necessary in order to elucidate the disclosure, whereas other parts may be omitted or merely suggested. Unless otherwise indicated, like reference numerals refer to like parts in different figures.

DETAILED DESCRIPTION

Figure 1:
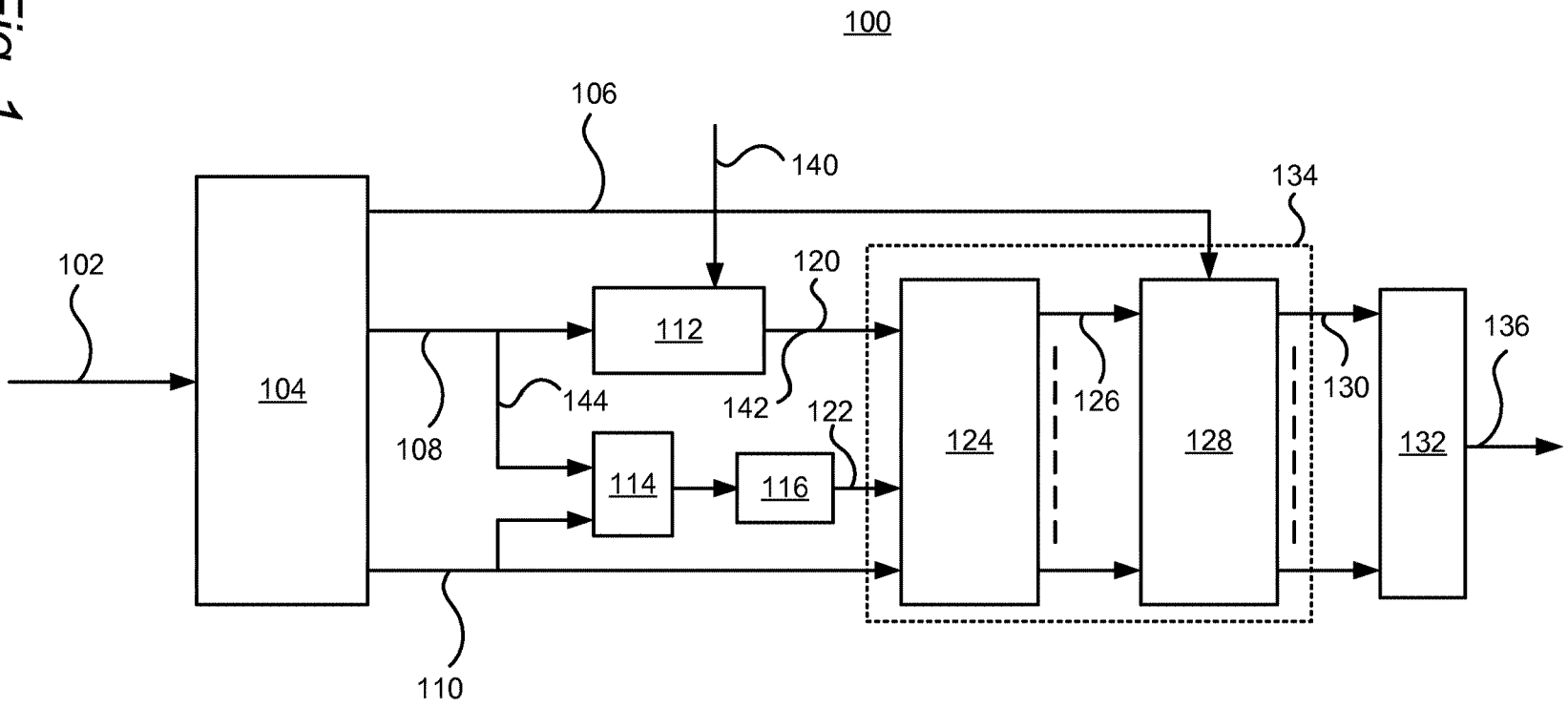
FIG. 1 shows a generalized block diagram of a high quality decoder for enhancing dialog in an audio system in accordance with exemplary embodiments.

In view of the above, the objective is to provide encoders and decoders and associated methods aiming at reducing the complexity of dialog enhancement in the decoder.

I. Overview—Decoder

According to a first aspect, example embodiments propose decoding methods, decoders, and computer program products for decoding. The proposed methods, decoders and computer program products may generally have the same features and advantages.

According to example embodiments there is provided a method for enhancing dialog in a decoder in an audio system, comprising the steps of: receiving a plurality of downmix signals, the downmix signals being a downmix of a plurality of audio objects including at least one object representing a dialog, receiving side information indicative of coefficients enabling reconstruction of the plurality of audio objects from the plurality of downmix signals, receiving data identifying which of the plurality of audio objects represents a dialog, modifying the coefficients by using an enhancement parameter and the data identifying which of the plurality of audio objects represents a dialog, and reconstructing at least the at least one object representing a dialog using the modified coefficients.

The enhancement parameter is typically a user-setting available at the decoder. A user may for example use a remote control for increasing the volume of the dialog. Consequently, the enhancement parameter is typically not provided to the decoder by an encoder in the audio system. In many cases, the enhancement parameter translates to a gain of the dialog, but it may also translate to an attenuation of the dialog. Moreover, the enhancement parameter may relate to certain frequencies of the dialog, e.g. a frequency dependent gain or attenuation of the dialog.

By the term dialog should, in the context of present specification, be understood that in some embodiments, only relevant dialog is enhanced and not e.g. background chatter and any reverberant version of the dialog. A dialog may comprise a conversation between persons, but also a monolog, narration or other speech.

As used herein audio object refers to an element of an audio scene. An audio object typically comprises an audio signal and additional information such as the position of the object in a three-dimensional space. The additional information is typically used to optimally render the audio object on a given playback system. The term audio object also encompasses a cluster of audio objects, i.e. an object cluster. An object cluster represents a mix of at least two audio objects and typically comprises the mix of the audio objects as an audio signal and additional information such as the position of the object cluster in a three-dimensional space.

The at least two audio objects in an object cluster may be mixed based on their individual spatial positions being close and the spatial position of the object cluster being chosen as an average of the individual object positions.

As used herein a downmix signal refers to a signal which is a combination of at least one audio object of the plurality of audio objects. Other signals of the audio scene, such as bed channels may also be combined into the downmix signal. The number of downmix signals is typically (but not necessarily) less than the sum of the number of audio objects and bed channels, explaining why the downmix signals are referred to as a downmix. A downmix signal may also be referred to as a downmix cluster.

As used herein side information may also be referred to as metadata.

By the term side information indicative of coefficients should, in the context of the present specification, be understood that the coefficients are either directly present in the side information sent in for example a bitstream from the encoder, or that they are calculated from data present in the side information.

According to the present method, the coefficients enabling reconstruction of the plurality of audio objects are modified for providing enhancement of the later reconstructed at least one audio object representing a dialog. Compared to the conventional method of performing enhancement of the reconstructed at least one audio object representing a dialog after it has been reconstructed, i.e. without modifying the coefficients enabling reconstruction, the present method provides a reduced mathematical complexity and thus computational complexity of the decoder implementing the present method.

According to exemplary embodiments, the step of modifying the coefficients by using the enhancement parameter comprises multiplying the coefficients that enables reconstruction of the at least one object representing a dialog with the enhancement parameter. This is a computationally low complex operation for modifying the coefficients which still keeps the mutual ratio between the coefficients.

According to exemplary embodiments, the method further comprises: calculating the coefficients enabling reconstruction of the plurality of audio objects from the plurality of downmix signals from the side information.

According to exemplary embodiments, the step of reconstructing at least the at least one object representing a dialog comprises reconstructing only the at least one object representing a dialog.

In many cases, the downmix signals may correspond to a rendering or outputting of the audio scene to a given loudspeaker configuration, e.g. a standard 5.1 configuration. In such cases, low complexity decoding may be achieved by only reconstructing the audio objects representing dialog to be enhanced, i.e. not perform a full reconstruction of all the audio objects.

According to exemplary embodiments, the reconstruction of only the at least one object representing a dialog does not involve decorrelation of the downmix signals. This reduces the complexity of the reconstruction step. Moreover, since not all audio objects are reconstructed, i.e. the quality of the to-be rendered audio content may be reduced for those audio objects, using decorrelation when reconstructing the at least one object representing dialog would not improve the perceived audio quality of the enhanced rendered audio content. Consequently, decorrelation can be omitted.

According to exemplary embodiments, the method further comprises the step of: merging the reconstructed at least one object representing dialog with the downmix signals as at least one separate signal. Consequently, the reconstructed at least one object do not need to be mixed into, or combined with, the downmix signals again. Consequently, according to this embodiment, information describing how the at least one object representing a dialog was mixed into the plurality of downmix signals by an encoder in the audio system is not needed.

According to exemplary embodiments, the method further comprises receiving data with spatial information corresponding to spatial positions for the plurality of downmix signals and for the at least one object representing a dialog, and rendering the plurality of downmix signals and the reconstructed at least one object representing a dialog based on the data with spatial information.

According to exemplary embodiments, the method further comprises combining the downmix signals and the reconstructed at least one object representing a dialog using information describing how the at least one object representing a dialog was mixed into the plurality of downmix signals by an encoder in the audio system. The downmix signals may be downmixed in order to support always-audio-out (AAO) for a certain loudspeaker configuration (e.g. a 5.1 configuration or a 7.1 configuration), i.e. the downmix signals can be used directly for playback on such a loudspeaker configuration. By combining the downmix signals and the reconstructed at least one object representing a dialog, dialog enhancement is achieved at the same time as AAO is still supported. In other words, according to some embodiments, the reconstructed, and dialog enhanced, at least one object representing a dialog is mixed back into the downmix signals again to still support AAO.

According to exemplary embodiments, the method further comprises rendering the combination of the downmix signals and the reconstructed at least one object representing a dialog.

According to exemplary embodiments, the method further comprises receiving information describing how the at least one object representing a dialog was mixed into the plurality of downmix signals by an encoder in the audio system. The encoder in the audio system may already have this type of information when downmixing the plurality of audio objects including at least one object representing a dialog, or the information may be easily calculated by the encoder.

According to exemplary embodiments, the received information describing how the at least one object representing a dialog was mixed into the plurality of downmix signals is coded by entropy coding. This may reduce the required bit rate for transmitting the information.

According to exemplary embodiments, the method further comprises the steps of: receiving data with spatial information corresponding to spatial positions for the plurality of downmix signals and for the at least one object representing a dialog, and calculating the information describing how the at least one object representing a dialog was mixed into the plurality of downmix signals by an encoder in the audio system based on the data with spatial information. An advantage of this embodiment may be that the bit rate required for transmitting the bitstream including the downmix signals and side information to the encoder is reduced, since the spatial information corresponding to spatial positions for the plurality of downmix signals and for the at least one object representing a dialog may be received by the decoder anyway and no further information or data needs to be received by the decoder.

According to exemplary embodiments, the step of calculating the information describing how the at least one object representing a dialog was mixed into the plurality of downmix signals comprises applying a function which map the spatial position for the at least one object representing a dialog onto the spatial positions for the plurality of downmix signals. The function may e.g. be a 3D panning algorithm such as a vector base amplitude panning (VBAP) algorithm. Any other suitable function may be used.

According to exemplary embodiments, the step of reconstructing at least the at least one object representing a dialog comprises reconstructing the plurality of audio objects. In that case, the method may comprise receiving data with spatial information corresponding to spatial positions for the plurality of audio objects, and rendering the reconstructed plurality of audio objects based on the data with spatial information. Since the dialog enhancement is performed on the coefficients enabling reconstruction of the plurality of audio objects, as described above, the reconstruction of the plurality of audio objects and the rendering to the reconstructed audio object, which are both matrix operations, may be combined into one operation which reduces the complexity of the two operations.

According to example embodiments there is provided a computer-readable medium comprising computer code instructions adapted to carry out any method of the first aspect when executed on a device having processing capability.

According to example embodiments there is provided a decoder for enhancing dialog in an audio system. The decoder comprises a receiving stage configured for: receiving a plurality downmix signals, the downmix signals being a downmix of a plurality of audio objects including at least one object representing a dialog, receiving side information indicative of coefficients enabling reconstruction of the plurality of audio objects from the plurality of downmix signals, and receiving data identifying which of the plurality of audio objects represents a dialog. The decoder further comprises a modifying stage configured for modifying the coefficients by using an enhancement parameter and the data identifying which of the plurality of audio objects represents a dialog. The decoder further comprises a reconstructing stage configured for reconstructing at least the at least one object representing a dialog using the modified coefficients.

II. Overview—Encoder

According to a second aspect, example embodiments propose encoding methods, encoders, and computer program products for encoding. The proposed methods, encoders and computer program products may generally have the same features and advantages. Generally, features of the second aspect may have the same advantages as corresponding features of the first aspect.

According to example embodiments there is provided a method for encoding a plurality of audio objects including at least one object representing a dialog, comprising the steps of: determining a plurality of downmix signals being a downmix of the plurality of audio objects including at least one object representing a dialog, determining side information indicative of coefficients enabling reconstruction of the plurality of audio objects from the plurality of downmix signals, determining data identifying which of the plurality of audio objects represents a dialog and forming a bitstream comprising the plurality of downmix signals, the side information and the data identifying which of the plurality of audio objects represents a dialog.

According to exemplary embodiments, the method further comprises the steps of determining spatial information corresponding to spatial positions for the plurality of downmix signals and for the at least one object representing a dialog, and including said spatial information in the bitstream.

According to exemplary embodiments, the step of determining a plurality of downmix signals further comprises determining information describing how the at least one object representing a dialog is mixed into the plurality of downmix signals. This information describing how the at least one object representing a dialog is mixed into the plurality of downmix signals is according to this embodiment included in the bitstream.

According to exemplary embodiments, the determined information describing how the at least one object representing a dialog is mixed into the plurality of downmix signals is encoded using entropy coding.

According to exemplary embodiments, the method further comprises the steps of determining spatial information corresponding to spatial positions for the plurality of audio objects, and including the spatial information corresponding to spatial positions for the plurality of audio objects in the bitstream.

According to example embodiments there is provided a computer-readable medium comprising computer code instructions adapted to carry out any method of the second aspect when executed on a device having processing capability.

According to example embodiments there is provided an encoder for encoding a plurality of audio objects including at least one object representing a dialog. The encoder comprises a downmixing stage configured for: determining a plurality of downmix signals being a downmix of the plurality of audio objects including at least one object representing a dialog, determining side information comprising indicative of coefficients enabling reconstruction of the plurality of audio objects from the plurality of downmix signals, and a coding stage configured for: forming a bitstream comprising the plurality of downmix signals and the side information, wherein the bitstream further comprises data identifying which of the plurality of audio objects represents a dialog.

III. Example Embodiments

As described above, dialog enhancement is about increasing the dialog level relative to the other audio components. When organized properly from content creation, object content is well suited for dialog enhancement as the dialog can be represented by separate objects. Parametric coding of the objects (i.e. object clusters or downmix signals) may introduce mixing between dialog and other objects.

A decoder for enhancing dialog mixed into such object clusters will now be described in conjunction with FIGS. 1-3. FIG. 1, shows a generalized block diagram of a high quality decoder 100 for enhancing dialog in an audio system in accordance with exemplary embodiments. The decoder 100 receives a bitstream 102 at a receiving stage 104. The receiving stage 104 may also be viewed upon as a core decoder, which decodes the bitstream 102 and outputs the decoded content of the bitstream 102. The bitstream 102 may for example comprise a plurality of downmix signals 110, or downmix clusters, which are a downmix of a plurality of audio objects including at least one object representing a dialog. The receiving stage thus typically comprises a downmix decoder component which may be adapted to decode parts of the bitstream 102 to form the downmix signals 110 such that they are compatible with sound decoding system of the decoder, such as Dolby Digital Plus or MPEG standards such as AAC, USAC or MP3. The bitstream 102 may further comprise side information 108 indicative of coefficients enabling reconstruction of the plurality of audio objects from the plurality of downmix signals. For efficient dialog enhancement, the bitstream 102 may further comprise data 108 identifying which of the plurality of audio objects represents a dialog. This data 108 may be incorporated in the side information 108, or it may be separate from the side information 108. As discussed in detail below, the side information 108 typically comprises dry upmix coefficients which can be translated into a dry upmix matrix C and wet upmix coefficients which can be translated into a wet upmix matrix P.

The decoder 100 further comprises a modifying stage 112 which is configured for modifying the coefficients indicated in the side information 108 by using an enhancement parameter 140 and the data 108 identifying which of the plurality of audio objects represents a dialog. The enhancement parameter 140 may be received at the modifying stage 112 in any suitable way. According to embodiments, the modifying stage 112 modifies both the dry upmix matrix C and wet upmix matrix P, at least the coefficients corresponding to the dialog.

The modifying stage 112 is thus applying the desired dialog enhancement to the coefficients corresponding to the dialog object(s). According to one embodiment, the step of modifying the coefficients by using the enhancement parameter 140 comprises multiplying the coefficients that enable reconstruction of the at least one object representing a dialog with the enhancement parameter 140. In other words, the modification comprises a fixed amplification of the coefficients corresponding with the dialog objects.

In some embodiments the decoder 100 further comprises a pre-decorrelator stage 114 and a decorrelator stage 116. These two stages 114, 116 together form decorrelated versions of combinations of the downmix signals 110, which will be used later for reconstruction (e.g. upmixing) of the plurality of audio objects from the plurality of downmix signals 110. As can be seen in FIG. 1, the side information 108 may be fed to the pre-decorrelator stage 114 prior to the modification of the coefficients in the modifying stage 112. According to embodiments, the coefficients indicated in the side information 108 are translated into a modified dry upmix matrix 120, a modified wet upmix matrix 142 and a pre-decorrelator matrix Q denoted as reference 144 in FIG. 1. The modified wet upmix matrix is used for upmixing the decorrelator signals 122 at a reconstruction stage 124 as described below.

The pre-decorrelator matrix Q is used at the pre-decorrelator stage 114 and may according to embodiments be calculated by:

$$Q=(\text{abs } P)^T C$$

where abs P denotes the matrix obtained by taking absolute values of the elements of the unmodified wet upmix matrix P and C denotes the unmodified dry upmix matrix.

Alternative ways to compute the pre-decorrelation coefficients Q based on the dry upmix matrix C and wet upmix matrix P are envisaged. For example, it may be computed as $Q=(\text{abs } P_0)^T C$, where the matrix $P_0$ is obtained by normalizing each column of P.

Computing the pre-decorrelator matrix Q only involves computations with relatively low complexity and may therefore be conveniently employed at a decoder side. However, according to some embodiments, the pre-decorrelator matrix Q is included in the side information 108.

In other words, the decoder may be configured for calculating the coefficients enabling reconstruction of the plurality of audio objects 126 from the plurality of downmix signals from the side information. In this way, the pre-decorrelator matrix is not influenced by any modification made to the coefficients in the modifying stage which may be advantageous since, if the pre-decorrelator matrix is modified, the decorrelation process in the pre-decorrelator stage 114 and a decorrelator stage 116 may introduce further dialog enhancement which may not be desired. According to other embodiments the side information is fed to the pre-decorrelator stage 114 after to the modification of the coefficients in the modifying stage 112. Since the decoder 100 is a high quality decoder, it may be configured for reconstructing all of the plurality of audio objects. This is done at the reconstruction stage 124. The reconstruction stage 124 of the decoder 100 thus receives the downmix signals 110, the decorrelated signals 122 and the modified coefficients 120, 142 enabling reconstruction of the plurality of audio objects from the plurality of downmix signals 110. The reconstruction stage can thus parametrically reconstruct the audio objects 126 prior to rendering the audio objects to the output configuration of the audio system, e.g. a 7.1.4 channel output. However, typically this will not happen in many cases, as the audio object reconstruction at the reconstruction stage 124 and rendering at the rendering stage 128 are matrix operations that can be combined (denoted by the dashed line 134) for a computationally efficient implementation. In order to render the audio objects at a correct position in a three-dimensional space, the bitstream 102 further comprises data 106 with spatial information corresponding to spatial positions for the plurality of audio objects.

It may be noted that according to some embodiments, the decoder 100 will be configured to provide the reconstructed objects as an output, such that they can be processed and rendered outside the decoder. According to this embodiment, the decoder 100 consequently output the reconstructed audio objects 126 and does not comprise the rendering stage 128.

The reconstruction of the audio objects is typically performed in a frequency domain, e.g. a Quadrature Mirror Filters (QMF) domain. However, the audio may need to be outputted in a time domain. For this reason, the decoder further comprise a transforming stage 132 in which the rendered signals 130 are transformed to the time domain, e.g. by applying an inverse quadrature mirror filter (IQMF) bank. According to some embodiments, the transformation at the transformation stage 132 to the time domain may be performed prior to rendering the signals in the rendering stage 128.

In summary, the decoder implementation described in conjunction with FIG. 1 efficiently implements dialog enhancement by modifying the coefficients enabling reconstruction of the plurality of audio objects from the plurality of downmix signals prior to the reconstruction of the audio objects. Performing the enhancement on the coefficients costs a few multiplications per frame, one for each coefficient related to the dialog times the number of frequency bands. Most likely in typical cases the number of multiplications will be equal to the number of downmix channels (e.g. 5-7) times the number of parameter bands (e.g. 20-40), but could be more if the dialog also gets a decorrelation contribution. By comparison, the prior art solution of performing dialog enhancement on the reconstructed objects results in a multiplication for each sample times the number of frequency bands times two for a complex signal. Typically this will lead to 16*64*2=2048 multiplication per frame, often more.

Audio encoding/decoding systems typically divide the time-frequency space into time/frequency tiles, e.g., by applying suitable filter banks to the input audio signals. By a time/frequency tile is generally meant a portion of the time-frequency space corresponding to a time interval and a frequency band. The time interval may typically correspond to the duration of a time frame used in the audio encoding/decoding system. The frequency band is a part of the entire frequency range of the whole frequency range of the audio signal/object that is being encoded or decoded. The frequency band may typically correspond to one or several neighbouring frequency bands defined by a filter bank used in the encoding/decoding system. In the case the frequency band corresponds to several neighbouring frequency bands defined by the filter bank, this allows for having non-uniform frequency bands in the decoding process of the audio signal, for example wider frequency bands for higher frequencies of the audio signal.

In an alternative output mode, for saving decoder complexity, the downmixed objects are not reconstructed. The downmix signals are in this embodiment considered as signals to be rendered directly to the output configuration, e.g. a 5.1 output configuration. This is also known as an always-audio-out (AAO) operation mode. FIGS. 2 and 3 describe decoders 200, 300 which allow enhancement of the dialog even for this low complexity embodiment.

Figure 2:
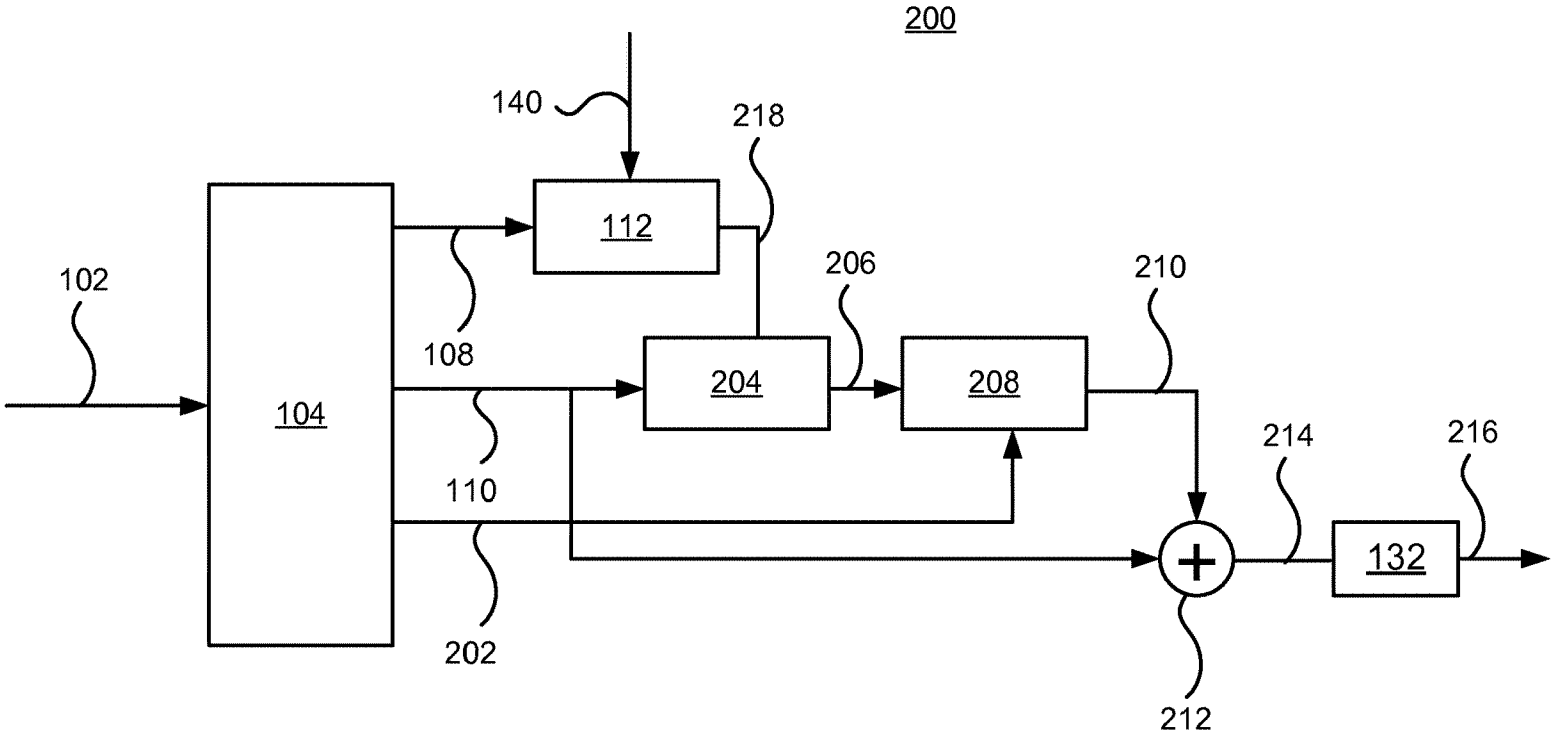
FIG. 2 shows a first generalized block diagram of a low complexity decoder for enhancing dialog in an audio system in accordance with exemplary embodiments.

FIG. 2 describes a low complexity decoder 200 for enhancing dialog in an audio system in accordance with first exemplary embodiments. The decoder 100 receives the bitstream 102 at the receiving stage 104 or core decoder. The receiving stage 104 may be configured as described in conjunction with FIG. 1. Consequently, the receiving stage outputs side information 108, and downmix signals 110. The coefficients indicated by the side information 108 are modified by the enhancement parameter 140 as described above by the modifying stage 112 with the difference that the it must be taken into account that the dialog is already present in the downmix signal 110 and consequently, the enhancement parameter may have to be scaled down before being used for modification of the side information 108, as described below. A further difference may be that since decorrelation is not employed in the low-complexity decoder 200 (as described below), the modifying stage 112 is only modifying the dry upmix coefficients in the side information 108 and consequently disregard any wet upmix coefficients present in the side information 108. In some embodiments, the correction may take into account an energy loss in the prediction of the dialog object caused by the omission the decorrelator contribution. The modification by the modifying stage 112 ensures that the dialog objects are reconstructed as enhancement signals that, when combined with the downmix signals, result in enhanced dialog. The modified coefficients 218 and the downmix signals are inputted to a reconstruction stage 204. At the reconstruction stage, only the at least one object representing a dialog may be reconstructed using the modified coefficients 218. In order to further reduce the decoding complexity of the decoder 200, the reconstruction of the at least one object representing a dialog at the reconstruction stage 204 does not involve decorrelation of the downmix signals 110. The reconstruction stage 204 thus generates dialog enhancement signal(s) 206. In many embodiments, the reconstruction stage 204 is a portion of the reconstruction stage 124, said portion relating to the reconstruction of the at least one object representing a dialog.

In order to still output signals according to the supported output configuration, i.e. the output configuration which the downmix signals 110 was downmixed in order to support (e.g 5.1 or 7.1 surround signals), the dialog enhanced signals 206 need to be downmixed into, or combined with, the downmix signals 110 again. For this reason, the decoder comprises an adaptive mixing stage 208 which uses information 202 describing how the at least one object representing a dialog was mixed into the plurality of downmix signals by an encoder in the audio system for mixing the dialog enhancement objects back into a representation 210 which corresponds to how the dialog objects are represented in the downmix signals 110. This representation is then combined 212 with the downmix signal 110 such that the resulting combined signals 214 comprises enhanced dialog.

The above described conceptual steps for enhancing dialog in a plurality of downmix signals may be implemented by a single matrix operation on the matrix D which represents one time-frequency tile of the plurality of downmix signals 110:

$$D_b = D + MD \qquad \text{equation 1}$$

where $D_b$ is a modified downmix 214 including the boosted dialog parts. The modifying matrix M is obtained by:

$$M = GC \qquad \text{equation 2}$$

where G is a [nbr of downmix channels, nbr of dialog objects] matrix of downmix gains, i.e. the information 202 describing how the at least one object representing a dialog was mixed into the currently decoded time-frequency tile D of the plurality of downmix signals 110. C is a [nbr of dialog objects, nbr of downmix channels] matrix of the modified coefficients 218.

An alternative implementation for enhancing dialog in a plurality of downmix signals may be implemented by a matrix operation on column vector X [nbr of downmix channels], in which each element represents a single time-frequency sample of the plurality of downmix signals 110:

$$X_b = EX \qquad \text{equation 3}$$

where $X_b$ is a modified downmix 214 including the enhanced dialog parts. The modifying matrix E is obtained by:

$$E = I + GC \qquad \text{equation 4}$$

where I is the [nbr of downmix channels, nbr of downmix channels] identity matrix, G is a [nbr of downmix channels, nbr of dialog objects] matrix of downmix gains, i.e. the information 202 describing how the at least one object representing a dialog was mixed into the currently decoded plurality of downmix signals 110 and C is a [nbr of dialog objects, nbr of downmix channels] matrix of the modified coefficients 218.

Matrix E is calculated for each frequency band and time sample in the frame. Typically the data for matrix E is transmitted once per frame and the matrix is calculated for each time sample in the time-frequency tile by interpolation with the corresponding matrix in the previous frame.

According to some embodiments, the information 202 is part of the bitstream 102 and comprises the downmix coefficients that were used by the encoder in the audio system for downmixing the dialog objects into the downmix signals.

In some embodiments, the downmix signals do not correspond to channels of a speaker configuration. In such embodiments it is beneficial to render the downmix signals to locations corresponding with the speakers of the configuration used for playback. For these embodiments the bitstream 102 may carry position data for the plurality of downmix signals 110.

An exemplary syntax of the bitstream corresponding to such received information 202 will now be described. Dialog objects may be mixed to more than one downmix signal. The downmix coefficients for each downmix channel may thus be coded into the bitstream according to the below table:

TABLE 1 downmix coefficients syntax

| Bit stream syntax | Downmix coefficient |
|---|---|
| 0 | 0 |
| 10000 | 1/15 |
| 10001 | 2/15 |
| 10010 | 3/15 |
| 10011 | 4/15 |
| 10100 | 5/15 |
| 10101 | 6/15 |
| 10110 | 7/15 |
| 10111 | 8/15 |
| 11000 | 9/15 |
| 11001 | 10/15 |
| 11010 | 11/15 |
| 11011 | 12/15 |
| 11100 | 13/15 |
| 11101 | 14/15 |
| 1111 | 1 |

A bitstream representing the downmix coefficients for an audio object which is downmixed such that the $5^{th}$ of 7 downmix signal comprises only the dialog object thus look like this: 0000111100. Correspondingly, a bitstream representing the downmix coefficients for an audio object which is downmixed for $1/15^{th}$ into the $5^{th}$ downmix signal and $14/15^{th}$ into the $7^{th}$ downmix signal thus looks like this: 000010000011101.

With this syntax, value 0 is transmitted most often, as dialog objects typically are not in all downmix signals and most likely in just one downmix signal. So the downmix coefficients may advantageously be coded by the entropy coding defined in the table above. Spending one bit more on the non-zero coefficients and just 1 for the 0 value brings the average word-length below 5 bits for most cases. E.g. 1/7*(1[bit]* 6[coefficients]+5[bit]*1[coefficient])=1.57 bit per coefficient on average when a dialog object is present in one out of 7 downmix signals. Coding all coefficients straightforward with 4 bits, the cost would be 1/7*(4[bits] *7[coefficients])=4 bits per coefficient. Only if the dialog objects are in 6 or 7 downmix signals (out of 7 downmix signals) it's more expensive than a straightforward coding. Using entropy coding as described above reduces the required bit rate for transmitting the downmix coefficients.

Alternatively Huffman coding can be used for transmitting the downmix coefficients.

According to other embodiments, the information 202 describing how the at least one object representing a dialog was mixed into the plurality of downmix signals by an encoder in the audio system is not received by the decoder but instead calculated at the receiving stage 104, or on another appropriate stage of the decoder 200. This reduces the required bit rate for transmitting the bitstream 102 received by the decoder 200. This calculation can be based on data with spatial information corresponding to spatial positions for the plurality of downmix signals 110 and for the at least one object representing a dialog. Such data is typically already known by the decoder 200 since it is typically included in the bitstream 102 by an encoder in the audio system. The calculation may comprise applying a function which maps the spatial position for the at least one object representing a dialog onto the spatial positions for the plurality of downmix signals 110. The algorithm may be a 3D panning algorithm, e.g. a Vector Based Amplitude Panning (VBAP) algorithm. VBAP is a method for positioning virtual sound sources, e.g. dialog objects, to arbitrary directions using a setup of multiple physical sound sources, e.g. loudspeakers, i.e. the speaker output configuration. Such algorithms can therefore be reused to calculate downmix coefficients by using the positions of the downmix signals as speaker positions.

Using the notation of equation 1 and 2 above, G is calculated by letting rendCoef=R(spkPos, sourcePos) where R a 3D panning algorithm (e.g. VBAP) to provide rendering coefficient vector rendCoef [nbrSpeakers×1] for a dialog object located at sourcePos (e.g. Cartesian coordinates) rendered to nbrSpeakers downmix channels located at spkPos (matrix where each row corresponds to the coordinates of a downmix signal). Then G is obtained by:

$$G=[rendCoef_1, rendCoef_2, \ldots, rendCoef_n] \quad \text{equation 5}$$

where rendCoef are the rendering coefficients for dialog object i, out of n dialog objects.

Since the reconstruction of the audio objects typically is performed in a QMF domain as described above in conjunction with FIG. 1, and the sound may need to be outputted in a time domain, the decoder 200 further comprises a transforming stage 132 in which the combined signals 214 are transformed into signals 216 in the time domain, e.g. by applying an inverse QMF.

According to embodiments, the decoder 200 may further comprise a rendering stage (not shown) upstreams to the transforming stage 132 or downstreams the transforming stage 132. As discussed above, the downmix signals, in some cases, do not correspond to channels of a speaker configuration. In such embodiments it is beneficial to render the downmix signals to locations corresponding with the speakers of the configuration used for playback. For these embodiments the bitstream 102 may carry position data for the plurality of downmix signals 110.

Figure 3:
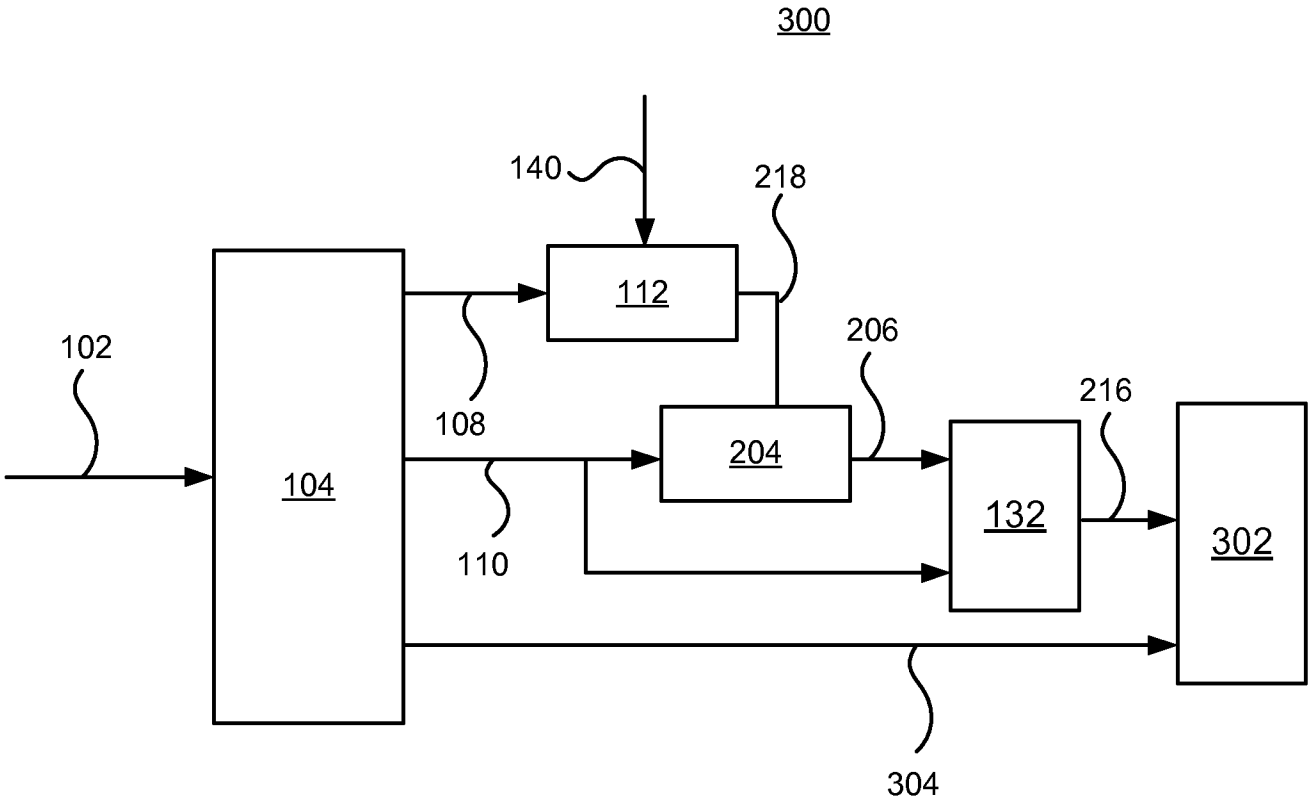
FIG. 3 shows a second generalized block diagram of a low complexity decoder for enhancing dialog in an audio system in accordance with exemplary embodiments, FIG. 4 describes a method for encoding a plurality of audio objects including at least one object representing a dialog in accordance with exemplary embodiments

An alternative embodiment of a low complexity decoder for enhancing dialog in an audio system is shown in FIG. 3. The main difference between the decoder 300 shown in FIG. 3 and the above described decoder 200 is that the reconstructed dialog enhancement objects 206 are not combined with the downmix signals 110 again after the reconstructions stage 204. Instead the reconstructed at least one dialog enhancement object 206 is merged with the downmix signals 110 as at least one separate signal. The spatial information for the at least one dialog object, which typically already is known by the decoder 300 as described above, is used for rendering the additional signal 206 together with the rendering of the downmix signals according to spatial position information 304 for the plurality of downmixs signals, after or before the additional signal 206 has been transformed to the time domain by the transformation stage 132 as described above.

For both the embodiments of the decoder 200, 300 described in conjunction with FIGS. 2-3, it must be taken into account that the dialog is already present in the downmix signal 110, and that enhanced reconstructed dialog objects 206 adds to this no matter if they are combined with the downmix signals 110 as described in conjunction with FIG. 2 or if they are merged with the downmix signals 110 as described in conjunction with FIG. 3. Consequently, the enhancement parameter $g_{DE}$ needs to be subtracted by, for example, 1 if the magnitude of the enhancement parameter is calculated based on that the existing dialog in the downmix signals has the magnitude 1.

Figure 4:
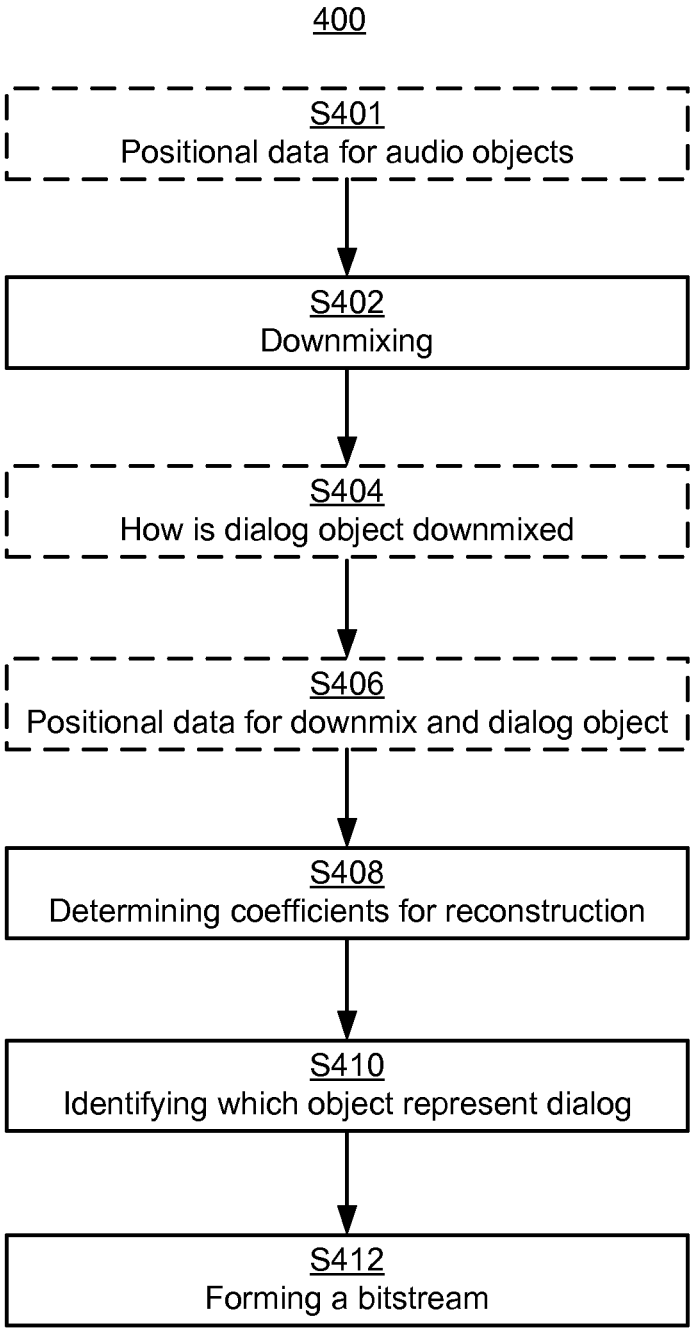

FIG. 4 describes a method 400 for encoding a plurality of audio objects including at least one object representing a dialog in accordance with exemplary embodiments. It should be noted that the order of the steps of the method 400 shown in FIG. 4 are shown by way of example.

A first step of the method 400 is an optional step of determining S401 spatial information corresponding to spatial positions for the plurality of audio objects. Typically, object audio is accompanied by a description of where each object should be rendered. This is typically done in terms of coordinates (e.g. Cartesian, polar, etc.).

A second step of the method is the step of determining S402 a plurality of downmix signals being a downmix of the plurality of audio objects including at least one object representing a dialog. This may also be referred to as a downmixing step.

For example, each of the downmix signals may be a linear combination of the plurality of audio objects. In other embodiments, each frequency band in a downmix signal may comprise different combinations of the plurality of audio object. An audio encoding system which implements this method thus comprises a downmixing component which determines and encodes downmix signals from the audio objects. The encoded downmix signals may for example be a 5.1 or 7.1 surround signals which is backwards compatible with established sound decoding systems such as Dolby Digital Plus or MPEG standards such as AAC, USAC or MP3 such that AAO is achieved.

The step of determining S402 a plurality of downmix signals may optionally comprise determining S404 information describing how the at least one object representing a dialog is mixed into the plurality of downmix signals. In many embodiments, the downmix coefficients follow from the processing in the downmix operation. In some embodiments this may be done by comparing the dialog object(s) with the downmix signals using a minimum mean square error (MMSE) algorithm.

There are many ways to downmix audio objects, for example, an algorithm that downmixes objects that are close together spatially may be used. According to this algorithm, it is determined at which positions in space there are concentrations of objects. These are then used as centroids for the downmix signal positions. This is just one example. Other examples include keeping the dialog objects separate from the other audio objects if possible when downmixing, in order to improve dialog separation and to further simplify dialog enhancement on a decoder side.

The fourth step of the method 400 is the optional step of determining S406 spatial information corresponding to spatial positions for the plurality of downmix signals. In case the optional step of determining S401 spatial information corresponding to spatial positions for the plurality of audio objects has been omitted, the step S406 further comprises determining spatial information corresponding to spatial positions for the at least one object representing a dialog.

The spatial information is typically known when determining S402 the plurality of downmix signals as described above.

The next step in the method is the step of determining S408 side information indicative of coefficients enabling reconstruction of the plurality of audio objects from the plurality of downmix signals. These coefficients may also be referred to as upmix parameters. The upmix parameters may for example be determined from the downmix signals and the audio objects, by e.g. MMSE optimization. The upmix parameters typically comprise dry upmix coefficients and wet upmix coefficients. The dry upmix coefficients define a linear mapping of the downmix signal approximating the audio signals to be encoded. The dry upmix coefficients thus are coefficients defining the quantitative properties of a linear transformation taking the downmix signals as input and outputting a set of audio signals approximating the audio signals to be encoded. The determined set of dry upmix coefficients may for example define a linear mapping of the downmix signal corresponding to a minimum mean square error approximation of the audio signal, i.e. among the set of linear mappings of the downmix signal, the determined set of dry upmix coefficients may define the linear mapping which best approximates the audio signal in a minimum mean square sense.

The wet upmix coefficients may for example be determined based on a difference between, or by comparing, a covariance of the audio signals as received and a covariance of the audio signals as approximated by the linear mapping of the downmix signal.

In other words, the upmix parameters may correspond to elements of an upmix matrix which allows reconstruction of the audio objects from the downmix signals. The upmix parameters are typically calculated based on the downmix signal and the audio objects with respect to individual time/frequency tiles. Thus, the upmix parameters are determined for each time/frequency tile. For example, an upmix matrix (including dry upmix coefficients and wet upmix coefficients) may be determined for each time/frequency tile.

The sixth step of the method for encoding a plurality of audio objects including at least one object representing a dialog shown in FIG. 4 is the step of determining S410 data identifying which of the plurality of audio objects represents a dialog. Typically the plurality of audio objects may be accompanied with metadata indicating which objects contain dialog. Alternatively, a speech detector may be used as known from the art.

The final step of the described method is the step S412 of forming a bitstream comprising at least the plurality of downmix signals as determined by the downmixing step S402, the side information as determined by the step S408 where coefficients for reconstruction is determined, and the data identifying which of the plurality of audio objects represents a dialog as described above in conjunction with step S410. The bitstream may also comprise the data outputted or determined by the optional steps S401, S404, S406, S408 above.

Figure 5:
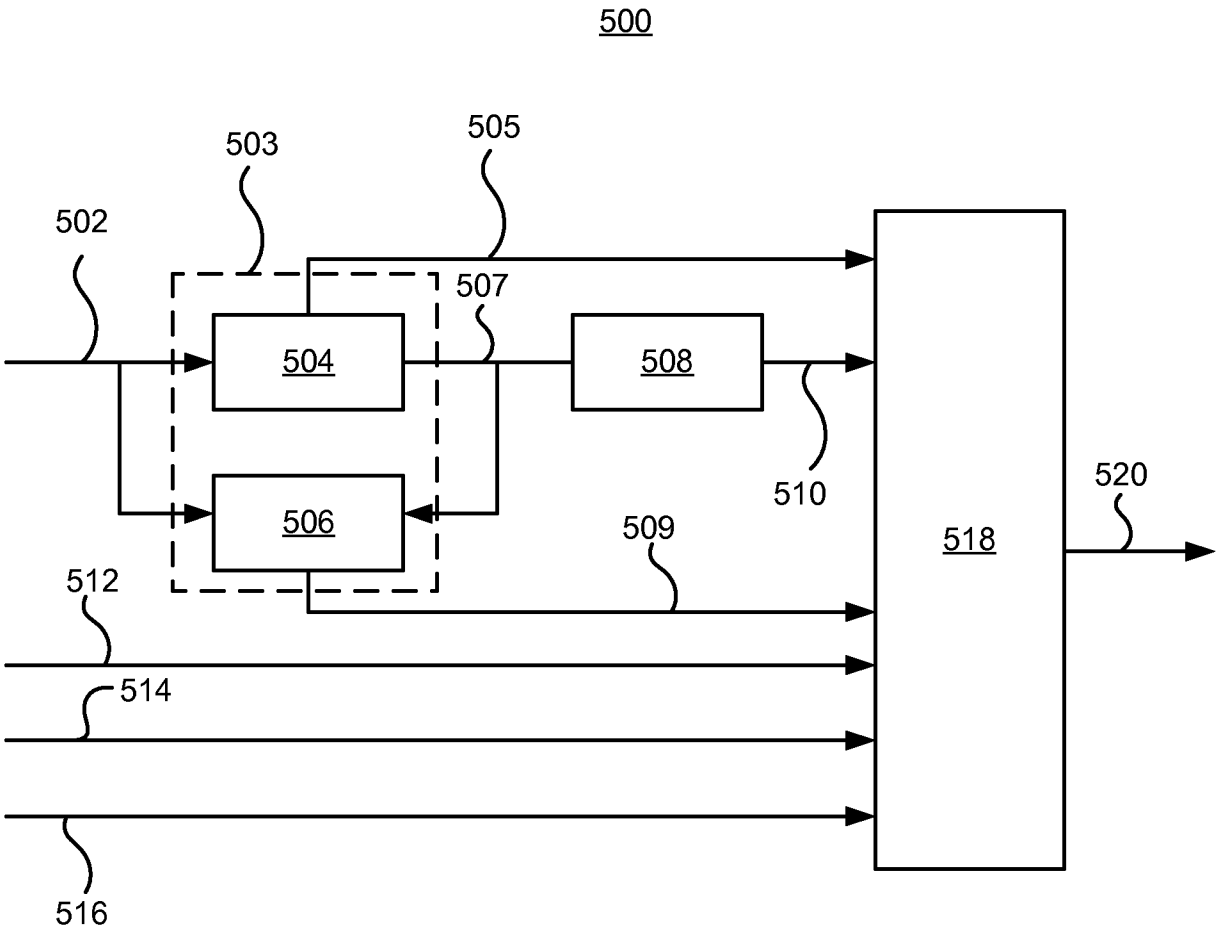
FIG. 5 shows a generalized block diagram of an encoder for encoding a plurality of audio objects including at least one object representing a dialog in accordance with exemplary embodiments.

In FIG. 5, a block diagram of an encoder 500 is shown by way of example. The encoder is configured to encode a plurality of audio objects including at least one object representing a dialog, and finally for transmitting a bitstream 520 which may be received by any of the decoders 100, 200, 300 as described in conjunction with FIGS. 1-3 above.

The decoder comprises a downmixing stage 503 which comprises a downmixing component 504 and a reconstruction parameters calculating component 506. The downmixing component receives a plurality of audio objects 502 including at least one object representing a dialog and determines a plurality of downmix signals 507 being a downmix of the plurality of audio objects 502. The downmix signals may for example be a 5.1 or 7.1 surround signals. As described above, the plurality of audio objects 502 may actually be a plurality of object clusters 502. This means that upstream of the downmixing component 504, a clustering component (not shown) may exist which determines a plurality of object clusters from a larger plurality of audio objects.

The downmix component 504 may further determine information 505 describing how the at least one object representing a dialog is mixed into the plurality of downmix signals.

The plurality of downmix signals 507 and the plurality of audio objects (or object clusters) are received by the reconstruction parameters calculating component 506 which determines, for example using a Minimum Mean Square Error (MMSE) optimization, side information 509 indicative of coefficients enabling reconstruction of the plurality of audio objects from the plurality of downmix signals. As described above, the side information 509 typically comprises dry upmix coefficients and wet upmix coefficients.

The exemplary encoder 500 may further comprise a downmix encoder component 508 which may be adapted to encode the downmix signals 507 such that they are backwards compatible with established sound decoding systems such as Dolby Digital Plus or MPEG standards such as AAC, USAC or MP3.

The encoder 500 further comprises a multiplexer 518 which combines at least the encoded downmix signals 510, the side information 509 and data 516 identifying which of the plurality of audio objects represents a dialog into a bitstream 520. The bitstream 520 may also comprise the information 505 describing how the at least one object representing a dialog is mixed into the plurality of downmix signals which may be encoded by entropy coding. Moreover, the bitstream 520 may comprise spatial information 514 corresponding to spatial positions for the plurality of downmix signals and for the at least one object representing a dialog. Further, the bitstream 520 may comprise spatial information 512 corresponding to spatial positions for the plurality of audio objects in the bitstream.

In summary, this disclosure falls into the field of audio coding, in particular it is related to the field of spatial audio coding, where the audio information is represented by multiple audio objects including at least one dialog object. In particular the disclosure provides a method and apparatus for enhancing dialog in a decoder in an audio system. Furthermore, this disclosure provides a method and apparatus for encoding such audio objects for allowing dialog to be enhanced by the decoder in the audio system.

Equivalents, Extensions, Alternatives and Miscellaneous

Further embodiments of the present disclosure will become apparent to a person skilled in the art after studying the description above. Even though the present description and drawings disclose embodiments and examples, the disclosure is not restricted to these specific examples. Numerous modifications and variations can be made without departing from the scope of the present disclosure, which is defined by the accompanying claims. Any reference signs appearing in the claims are not to be understood as limiting their scope.

Additionally, variations to the disclosed embodiments can be understood and effected by the skilled person in practicing the disclosure, from a study of the drawings, the disclosure, and the appended claims. In the claims, the word "comprising" does not exclude other elements or steps, and the indefinite article "a" or "an" does not exclude a plurality. The mere fact that certain measures are recited in mutually different dependent claims does not indicate that a combination of these measured cannot be used to advantage.

The systems and methods disclosed hereinabove may be implemented as software, firmware, hardware or a combination thereof. In a hardware implementation, the division of tasks between functional units referred to in the above description does not necessarily correspond to the division into physical units; to the contrary, one physical component may have multiple functionalities, and one task may be carried out by several physical components in cooperation. Certain components or all components may be implemented as software executed by a digital signal processor or microprocessor, or be implemented as hardware or as an application-specific integrated circuit. Such software may be distributed on computer readable media, which may comprise computer storage media (or non-transitory media) and communication media (or transitory media). As is well known to a person skilled in the art, the term computer storage media includes both volatile and nonvolatile, removable and non-removable media implemented in any method or technology for storage of information such as computer readable instructions, data structures, program modules or other data. Computer storage media includes, but is not limited to, RAM, ROM, EEPROM, flash memory or other memory technology, CD-ROM, digital versatile disks (DVD) or other optical disk storage, magnetic cassettes, magnetic tape, magnetic disk storage or other magnetic storage devices, or any other medium which can be used to store the desired information and which can be accessed by a computer. Further, it is well known to the skilled person that communication media typically embodies computer readable instructions, data structures, program modules or other data in a modulated data signal such as a carrier wave or other transport mechanism and includes any information delivery media.

What is claimed is:

1. A method for enhancing dialog in a decoder in an audio system, comprising the steps of:

receiving a plurality of downmix signals, the downmix signals being a downmix of a plurality of audio objects including at least one object representing a dialog, receiving side information indicative of coefficients enabling reconstruction of the plurality of audio objects from the plurality of downmix signals, receiving data identifying which of the plurality of audio objects represents a dialog, modifying the coefficients by using an enhancement parameter and the data identifying which of the plurality of audio objects represents a dialog, and reconstructing at least the at least one object representing a dialog using the modified coefficients.

2. The method of claim 1, wherein the step of modifying the coefficients by using the enhancement parameter comprises multiplying the coefficients that enable reconstruction of the at least one object representing a dialog with the enhancement parameter.

3. The method of claim 1, further comprising the step of:

calculating the coefficients enabling reconstruction of the plurality of audio objects from the plurality of downmix signals from the side information.

4. The method according to claim 1, wherein the step of reconstructing at least the at least one object representing a dialog comprises reconstructing only the at least one object representing a dialog.

5. The method according to claim 4, wherein the reconstruction of only the at least one object representing a dialog does not involve decorrelation of the downmix signals.

6. The method according to claim 4, further comprising the step of:

merging the reconstructed at least one object representing a dialog with the downmix signals as at least one separate signal.

7. The method according to claim 6, further comprising the steps of:

receiving data with spatial information corresponding to spatial positions for the plurality of downmix signals and for the at least one object representing a dialog, and rendering the plurality of downmix signals and the reconstructed at least one object representing a dialog based on the data with spatial information.

8. The method according to claim 4, further comprising the step of combining the downmix signals and the reconstructed at least one object representing a dialog using information describing how the at least one object representing a dialog was mixed into the plurality of downmix signals by an encoder in the audio system.

9. The method according to claim 8, further comprising the steps of: rendering the combination of the downmix signals and the reconstructed at least one object representing a dialog.

10. The method according to claim 8, further comprising the step of:

receiving information describing how the at least one object representing a dialog was mixed into the plurality of downmix signals by an encoder in the audio system.

11. The method according to claim 10, wherein the received information describing how the at least one object representing a dialog was mixed into the plurality of downmix signals is coded by entropy coding.

12. The method according to claim 8, further comprising the steps of receiving data with spatial information corresponding to spatial positions for the plurality of downmix signals and for the at least one object representing a dialog, and calculating the information describing how the at least one object representing a dialog was mixed into the plurality of downmix signals by an encoder in the audio system based on the data with spatial information.

13. The method according to claim 12, wherein the step of calculating comprises applying a function which map the spatial position for the at least one object representing a dialog onto the spatial positions for the plurality of downmix signals.

14. The method of claim 13, wherein the function is a 3D panning algorithm.

15. The method of claim 1, wherein the step of reconstructing at least the at least one object representing a dialog comprises reconstructing the plurality of audio objects.

16. The method of claim 15, further comprising the steps of:

receiving data with spatial information corresponding to spatial positions for the plurality of audio objects, and rendering the reconstructed plurality of audio objects based on the data with spatial information.

17. A non-transitory computer-readable storage medium comprising a sequence of instructions, which, when performed by one or more audio signal processing devices, cause the one or more audio signal processing devices to perform the method of claim 1.

18. A decoder for enhancing dialog in an audio system, the decoder comprising one or more audio signal processing devices that:

receive a plurality downmix signals, the downmix signals being a downmix of a plurality of audio objects including at least one object representing a dialog, receive side information indicative of coefficients enabling reconstruction of the plurality of audio objects from the plurality of downmix signals, receive data identifying which of the plurality of audio objects represents a dialog, modify the coefficients by using an enhancement parameter and the data identifying which of the plurality of audio objects represents a dialog, and reconstruct at least the at least one object representing a dialog using the modified coefficients.

19. A method for encoding a plurality of audio objects including at least one object representing a dialog, comprising the steps of:

determining a plurality of downmix signals being a downmix of the plurality of audio objects including at least one object representing a dialog, determining side information indicative of coefficients enabling reconstruction of the plurality of audio objects from the plurality of downmix signals, determining data identifying which of the plurality of audio objects represents a dialog, and forming a bitstream comprising the plurality of downmix signals, the side information and the data identifying which of the plurality of audio objects represents a dialog.

20. The method according to claim 19, wherein the step of determining a plurality of downmix signals further comprises determining information describing how the at least one object representing a dialog is mixed into the plurality of downmix signals, and wherein the method further comprising the step of:

including the information describing how the at least one object representing a dialog is mixed into the plurality of downmix signals in the bitstream.

* * * * *